US006630037B1

(12) United States Patent
Sawada et al.

(10) Patent No.: US 6,630,037 B1
(45) Date of Patent: Oct. 7, 2003

(54) HIGH STRENGTH ALUMINUM ALLOY FORGINGS

(75) Inventors: Hiroki Sawada, Mie (JP); Takayuki Kitano, Shimonoseki (JP); Manabu Nakai, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 171 days.

(21) Appl. No.: 09/379,570

(22) Filed: Aug. 24, 1999

(30) Foreign Application Priority Data

Aug. 25, 1998 (JP) ..... 10-238564

(51) Int. Cl.[7] ..... C22C 21/08

(52) U.S. Cl. ..... 148/417; 420/534; 420/535; 148/691; 148/552

(58) Field of Search ..... 148/439, 417, 148/691, 552; 420/534, 535

(56) References Cited

U.S. PATENT DOCUMENTS

| | | | | |
|---|---|---|---|---|
| 4,082,578 | | 4/1978 | Evancho et al. | |
| 4,490,189 | | 12/1984 | Develay | |
| 4,840,852 | * | 6/1989 | Hyland et al. | 428/654 |
| 5,503,690 | * | 4/1996 | Wade et al. | 148/550 |
| 5,571,347 | * | 11/1996 | Bergsma | 148/550 |
| 5,888,320 | * | 3/1999 | Dorward | 148/690 |

FOREIGN PATENT DOCUMENTS

| | | |
|---|---|---|
| DE | 44 21 744 | 1/1995 |
| EP | 0 676 480 | 10/1995 |
| JP | 6-256880 | 9/1994 |

* cited by examiner

*Primary Examiner*—Roy King
*Assistant Examiner*—Janelle Combs Morillo
(74) *Attorney, Agent, or Firm*—Oblon, Spivak, McClelland, Maier & Neustadt, P.C.

(57) ABSTRACT

High strength and high toughness aluminum alloy forgings having, as a whole, a strength at $\sigma_{0.2}$ of 315 N/mm$^2$ or more and an impact shock value of 20 J/cm$^2$ or more, wherein the aluminum alloy material contains Mg: 0.6–1.6%, Si: 0.8–1.8%, Cu: 0.1–1.0%, Fe: 0.30% or less, one or more of Mn: 0.15–0.6%, Cr: 0.1–0.2% and Zr: 0.1–0.2%, and the balance of Al and inevitable impurities, wherein the volume fraction of total constituents phase particles ($Mg_2Si$ and Al—Fe—Si—(Mn, Cr, Zr) series intermetallic compounds) in the aluminum alloy structure in the forgings is 1.5% or less per unit area.

10 Claims, 2 Drawing Sheets

HIGH STRENGTH ALUMINUM ALLOY FORGINGS

BACKGROUND OF THE INVENTION

1. Field of the Invention

The present invention concerns an Al—Mg—Si series high strength and high toughness aluminum alloy forgings (aluminum is hereinafter simply referred to as Al) suitable, particularly, to parts for transportation machines such as suspension parts for automobiles.

2. Related Art

As is well-known, Al alloys such as of AA 6XXX series (Al—Mg—Si alloys) excellent in moldability and burn on hardenability have been used as structural materials or suspension parts such as knuckles, lower arms and upper arms for transportation machines of automobiles or vehicles, with an aim of reducing weight. The AA 6XXX series Al alloys are also excellent in other required characteristics such as mechanical properties, for example, formability or corrosion resistance or stress corrosion cracking capability and, in addition, also excellent in view of recycling property capable of re-using scraps as melting materials for AA 6XXX series since they contain less amount of alloying elements such as Mg.

Referring to suspension parts for the automobiles, for example, cast Al alloy materials or Al alloy forgings are used in view of the reduction for the production cost and fabrication into parts of complicate shapes. Among them, Al alloy forgings are used for those parts requiring mechanical properties such as higher strength and higher toughness. The Al alloy forgings are manufactured by soaking a cast alloy material and then applying hot forging such as mechanical forging and tempering such as T6 or aging treatment.

In recent years, it has been demanded for reducing the wall thickness and improving strength for those parts including suspensions for use in automobiles and it has been required also for the Al alloy forgings to improve strength and toughness. However, AA 6XXX series used at present for such application uses, inevitably cause insufficiency in the strength.

In view of the above, it has been proposed to improve strength and toughness of the Al alloy forgings, for example, in Japanese Published Unexamined Patent Application Hei 6-256880 by defining the ingredients of AA 6XXX series (Al—Mg—Si alloys) cast Al alloys for use in forgings used as parts such as suspensions of automobiles, reducing the average grain size as small as to 8 $\mu$m or less and reducing the secondary dendrite arm spacing (DAS) as narrow to 40 $\mu$m or less.

However, as shown in examples of Japanese Published Unexamined Patent Application Hei 6-256880, the secondary dendrite arm distance (DAS) of the Al alloy forgings obtained in this prior art is about 30 $\mu$m at the smallest and the Al alloy forgings has characteristics, as a result of up setting forging test for round bars, for example, a tensile strength ($\sigma_B$) of about 39.2–39.3 kgf/mm$^2$ (385–394 MPa) and a toughness ($L_c$) of from 2.2 to 2.3 kgf/mm$^2$ (about 22 J/cm$^2$ as the Charpy impact value) in a case where a forging ratio [(original ingot height $d_o$–crack occurring height $d_t$)/$d_o$] is 75%.

That is, in the upset forging test for round bars as in the prior art, since each of the portions for a round bar is forged uniformly, mechanical properties are uniform for each of the portions of the round bar. However, as shown in FIG. 2 as an example of Al alloy forgings for use in a suspension part of an automobile, the forging ratio is sometimes lowered depending on the portions of the part even by hot forging such as mechanical forging in an actual Al alloy forgings and mechanical properties are not uniform for each of the portions of the forgings. For example, in a case as shown in FIG. 2, even if the forging ratio is 75% for a portion $T_1$, the forging ratio for the portion $T_2$ is only about 50%. Then, the toughness for the portion with the lower forging ratio is inevitably lowered compared with other portions of higher forging ratio since cast structure remains even after forging.

Then, although the strength and the toughness of the Al alloy forgings obtained by this prior art are improved compared with Al alloys such as of AA 6061 or 6151, average toughness is poor in the Al alloy forgings, particularly, in such an Al alloy forgings in which the toughness for the portion is lowered because of the portion of the lowered forging ratio. That is, in the prior art, the level for the toughness is further lowered at a portion with the forging ratio of 75% or less, further, 50% or less and high yield strength and high toughness values requires for the entire part can not be obtained.

As a result, the forgings can not be applied to parts requiring higher strength and higher toughness as a entire portion and, more specifically, to those parts or members requiring a high strength of 315 N/mm$^2$ or more as $\sigma_{0.2}$ and a Charpy impact value of 20 J/cm$^2$ or more as the entire part, and this hinders the development of the Al alloy forgings to the application uses for suspension parts for use in automobiles.

The present invention has been accomplished in view of the foregoing situations and it is an object thereof to provide a high strength and high toughness Al alloy forgings excellent in average mechanical properties as an entire forgings even if a portion with low forging ratio is present, and applicable to those parts or members requiring high strength and high toughness as the entire forgings.

SUMMARY OF THE INVENTION

In order to attain the foregoing object, the feature of the Al alloy forgings according to the present invention resides in a high strength and high toughness aluminum alloy forgings containing Mg: 0.6–1.6% (mass % here and hereinafter), Si: 0.6–1.8% and Cu: 0.05–1.0%, Fe: 0.30% or less, one or more of Mn: 0.15–0.6%, Cr: 0.1–0.2% and Zr: 0.05–0.2%, hydrogen: 0.25 cc/100 g Al or less and the balance of Al and inevitable impurities, the Al alloy forgings being prepared by casting a cast Al alloy ingot at a cooling rate of 10° C./sec or higher, subjecting the same to a soaking heat treatment at a temperature of 530–600° C. and then hot forging into a forgings, in which the volume fraction of total constituents phase particles ($Mg_2Si$, Al—Fe—Si—(Mn, Cr, Zr) series intermetallic compounds) is 1.5% or less per unit area.

As a result of a study on the relationship between constituents and the toughness of Al alloy forgings, the present inventors have found that the volume fraction of constituents phase particles has a close concern with the toughness of the Al alloy forgings.

That is, the present inventors have found that, among the constituents of the cast Al alloy materials, $Mg_2Si$ and Al—Fe—Si—Mn, Al—Fe—Si—Cr or Al—Fe—Si—Zr series intermetallic compounds constitute starting points for the rupture (starting points for dimples).

More importantly, the present inventors further found that it is not significant that the constituents present in the Al alloy structure are large or of a long chained shape, but that dispersion of them at a spacing with each other contributes to the improvement of the toughness. That is, the constituents can not simply decreased or eliminated since they contribute to the insurance of required strength. However, it has been found that a necessary strength can be insured and a high average toughness can be insured even if the forging ratio is low or even if there is a portion with a low forging ratio, by controlling the form of the constituents that are present inevitably or present by requirement.

For example, no effective contribution can be obtained for the improvement of the toughness by merely controlling the form of the constituents, namely, by merely reducing the average size of the constituents in the cast material as described in Japanese Published Unexampled Patent Application Hei 6-256880. On the contrary to the idea disclosed in Japanese Published Unexamined Patent Application Hei 6-256880, the present inventors have found that the constituents in the cast material, even if their average size is large, can contribute to the improvement of the toughness so long as they are dispersed being spaced apart from each other (present dispersedly). That is, the constituents present densely with a narrow distance between each of them or being continued with each other deteriorate the toughness, particularly, destruction toughness even if the average size of them is small. On the other hand, in the present invention, the amount of the constituents, for example, of $Mg_2Si$ and Al—Fe—Si—(Mn, Cr, Zr) series intermetallic compounds is controlled or decreased except for the amount ensuring required strength.

Then, the volume fraction of total constituents phase particles ($Mg_2Si$ and Al—Fe—Si—(Mn, Cr, Zr) series intermetallic compounds) is selected in the present invention as an index well conforming the situation for the control of the amount of constituents and for the situation in which the constituents are dispersed with a spacing between each of them (not a state in which constituents are present densely with a small distance between each of them or present being chained continuously with each other).

The volume fraction of total constituents phase particles is determined by visual observation or by image analyzing observation using a scanning type electron microscope (SEM) at 800 magnification ratio, for the structure of a cast Al alloy or Al alloy forgings in the cross section along the thickness. Referring to the magnification ratio of the scanning type electron microscope, the volume fraction does not change so much when measured at a magnification factor from 400 to 800, but the number of constituents as the object to be measured is quite different in the magnification factor other than the above. Therefore, if the magnification ratio is different, the volume fraction to be measured differs greatly to loss the reproducibility for the definition of the area. Accordingly, in the present invention, the magnification factor of the scanning type electron microscope is determined as 800 as a standard for the definition of the volume fraction. Further, for ensuring reproducibility in the measurement of the volume fraction, it is preferred to observe with the number of field of view (measuring point) for the portion of the object to measure the volume fraction of the constituents being as 5 to 20 fields of view and take an average for the measured volume fraction of the constituents in each of the field of view.

Definition for the constituents in the present invention is to be explained. When the volume fraction of total constituents phase particles ($Mg_2Si$ and Al—Fe—Si—(Mn, Cr, Zr) series intermetallic compounds) is defined as 1.5% or less, preferably, 1.0% or less per unit area by the visual observation or by image analyzing observation with a scanning type electron microscope (SEM) at 800 magnification ratio, it is possible to obtain higher strength and higher toughness, preferably, a high toughness of 30 $J/cm^2$ or more in an average value with an average value of the yield strength at ($\sigma_{0.2}$) being 350 $N/mm^2$ or more required, for example, for suspension parts in use in automobiles.

On the other hand, if the volume fraction of total constituents phase particles exceeds 1.5% per unit area, high average toughness value as the entire part can not be obtained including a case of remarkable lowering of the toughness for a portion of a part in which the forging ratio is lowered even by hot forging (forging ratio of 75% or less).

DESCRIPTION OF THE PREFERRED EMBODIMENTS

Figure 1A:
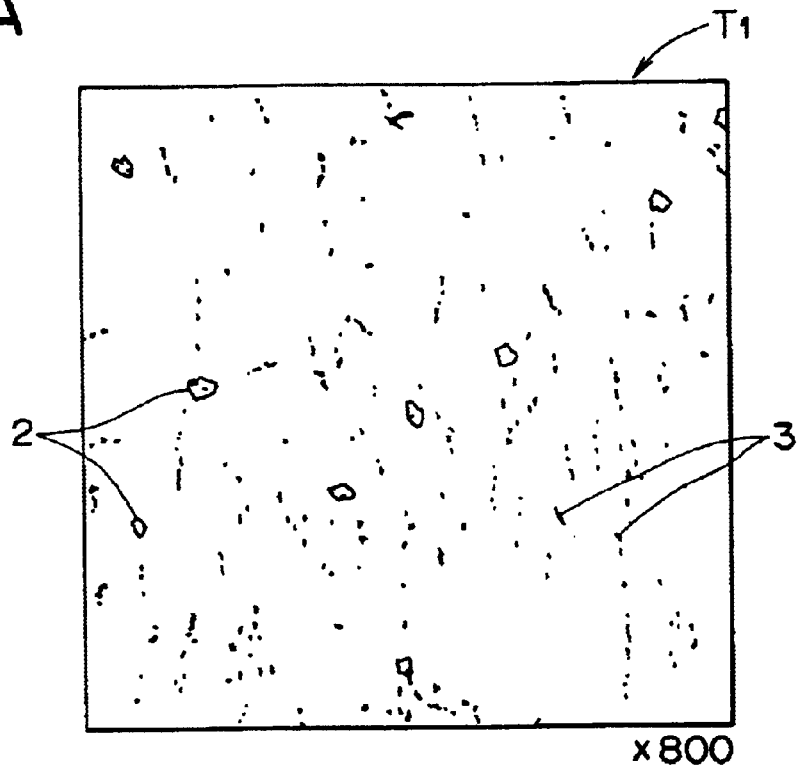
FIG. 1A is an explanatory view showing a microstructure of a Al alloy forgings and it relates to the present invention.
Figure 1B:
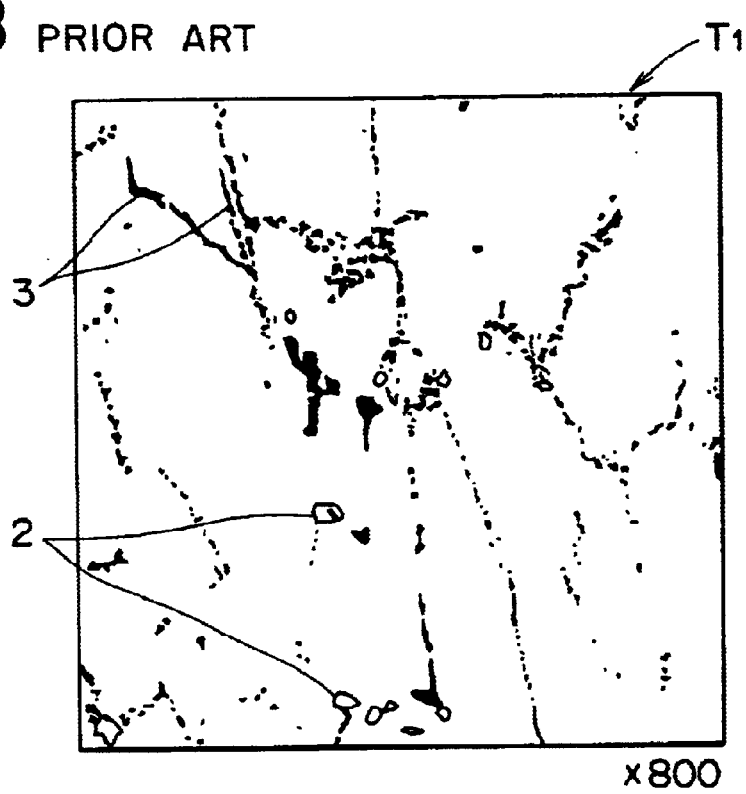
FIG. 1B PRIOR ART
FIG. 1B is an explanatory view showing a microstructure of a Al alloy forgings and it relates to the prior art.

FIGS. 1A and 1B are views showing a microstructure of a Al alloy forgings manufactured in examples to be described later in a cross section along the thickness direction of a portion $T_1$ in FIG. 2 by a scanning type electron microscope (SEM) at 800X (formed as schematic view based on SEM microscopic photograph). In FIGS. 1A and 1B, reference numeral 2 denotes $Mg_2Si$ constituents and 3 denotes Al—Fe—Si—(Mn, Cr, Zr) series intermetallic constituents. Al—Fe—Si—(Mn, Cr, Zr) series intermetallic compounds constituents 3 of the Al alloy forgings according to the present invention shown in FIG. 1A are dispersed finely with a distance from each other. On the contrary, Al—Fe—Si—(Mn, Cr, Zr) series constituents 3 of the Al alloy forgings of the prior art shown in FIG. 1B have shape in which constituents are chained lengthwise with each other.

The Al alloy forgings shown in FIG. 1A has a high strength of 350 $N/mm^2$ or more and a high toughness of 30 $J/cm^2$ or more, whereas the Al alloy forgings shown in FIG. 1B has a toughness of 20 $J/cm^2$ or less and there is a significant difference for the toughness between them. Further, individual Al—Fe—Si—(Mn, Cr, Zr) series intermetallic compounds 3 shown in each of FIGS. 1A and 1B have an average size of 8 $\mu$m or less as referred to in Japanese Published Unexamined Patent Application Hei 6-256880. Accordingly, this demonstrates that mere reduction of the average size of the constituents of the cast material can not effectively contribute to the improvement of the toughness, but a Al alloy forgings of high strength and high toughness can be obtained even when the average size of the constituents of the cast material is large and if they are dispersed being spaced apart from each other (present dispersed), namely, if the volume fraction of total constituents phase particles ($Mg_2Si$ and Al—Fe—Si—(Mn, Cr, Zr) series intermetallic compounds) is low.

Of course, the volume fraction of other constituents gives an effect on the toughness. Typical other constituents can include, for example, constituents of elemental Si, constituents of $Al_7Cu_2Fe$, $Al_{12}(Fe,Mn)_3Cu_2$, $(Fe,Mn)Al_6$ and a compound phase of Cu or Mg with Al, $Al_2Cu_2Mg$ and $Al_2Cu_2$.

Among them, constituents of elemental Si constitute starting points of material destruction to remarkably lower the toughness. Accordingly, it is necessary that no substantial constituents of elemental Si are present and, more specifically, it is necessary that constituents of elemental Si are not observed by a scanning type electron microscope at 800 magnification ratio. In a usual production process to be described later, constituents of elemental Si are not present substantially in the structure of the cast Al alloy material or forged alloy material Further, for other constituents of $Al_7Cu_2Fe$, $Al_{12}(Fe,Mn)_3Cu_2$, $(Fe,Mn)Al_6$, $Al_2Cu_2Mg$ and $Al_2Cu_2$, it is also necessary that the volume fraction is reduced in order to improve the toughness like that the $Mg_2Si$, Al—Fe—Si—(Mn, Cr, Zr) series intermetallic compounds. However, the absolute amount of the constituents is small compared with the amount of Al—Fe—Si—(Mn, Cr, Zr) series intermetallic compounds and the volume fraction is necessarily decreased accompanied by the reduction of the volume fraction of total constituents phase particles ($Mg_2Si$ and Al—Fe—Si—(Mn, Cr, Zr) series intermetallic compounds). Accordingly, in the present invention, no particular definition is made to other constituents than $Mg_2Si$ and Al—Fe—Si—(Mn, Cr, Zr) series constituents particularly.

Then, in order to satisfy the definition for the constituents of the Al alloy forgings in the present invention and ensure the high strength and high toughness of the Al alloy forgings, it is important to restrict the volume fraction of total constituents phase particles ($Mg_2Si$ and Al—Fe—Si—(Mn, Cr, Zr) series intermetallic compounds) to 1.5% or less per unit area in the stage of forming the cast ingot and in the soaking step for the cast ingot that control the formation of the constituents. Since the volume fraction of the constituents formed can not substantially be controlled in the forging step, the volume fraction of the constituents in the forgings in the present invention is controlled in the stage of forming cast material at the step of soaking the cast material.

Figure 2:
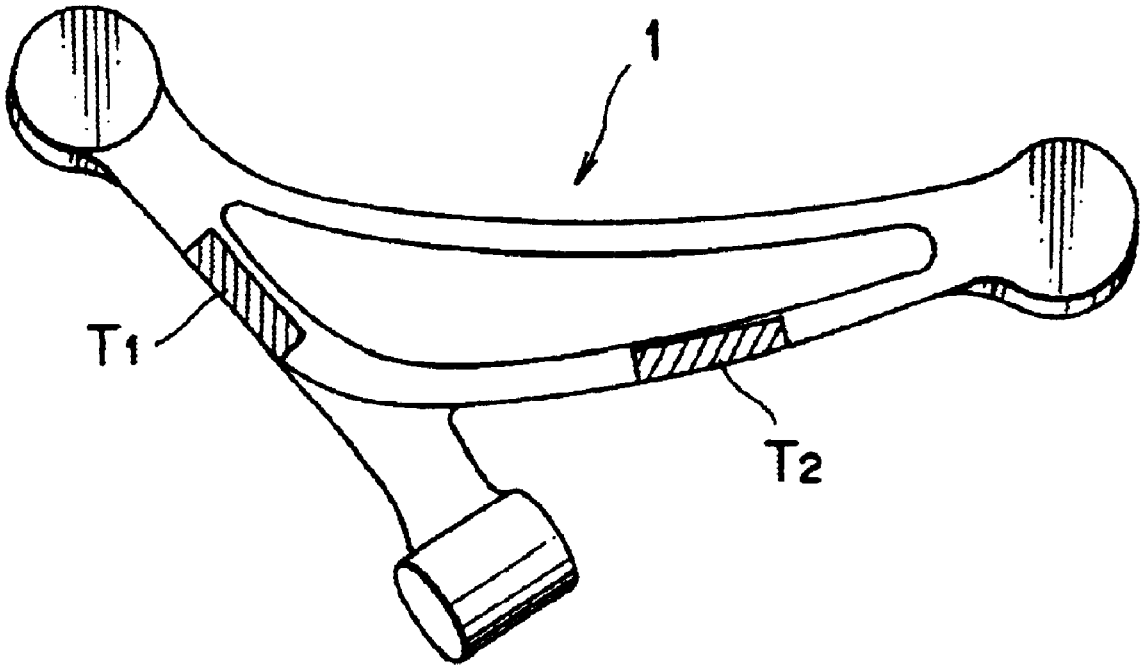
FIG. 2 is an explanatory view showing an embodiment of a Al alloy forgings for use in a suspension part of an automobile.

The average value for the yield strength or the toughness referred to in the present invention means the average for a portion $T_1$ where the forging ratio is highest, namely, the yield strength or the toughness is highest (forging ratio: 75%) and for a portion $T_2$ where the forging ratio is lowest, namely, the yield strength or the toughness is lowest (forging ratio: 50%) in the example shown in FIG. 2. It does not means to take an average only for the values of such two points but, depending on the material or the shape of the member, an average may be taken from values for a plurality of portions further requiring insurance for the mechanical properties.

Cast Ingot

Further, in the cast ingot for use in the forgings in the present invention, the secondary dendrite arm spacing (DAS) of the cast material is decreased to 30 $\mu$m or less for insuring the high toughness of the Al alloy forgings. This makes the grains finer in the Al alloy cast ingot and Al alloy forgings and reduces the volume fraction of total constituents phase particles ($Mg_2Si$ and Al—Fe—Si—(Mn, Cr, Zr) series intermetallic compounds), to improve the toughness of the Al alloy forgings. When the secondary dendrite arm spacing (DAS) in the cast ingot increases in excess of 30 $\mu$m, the toughness of the entire Al alloy forgings can not be improved if a portion of low forging ratio is present as in the case where the secondary dendrite arm spacing (DAS) of the Al alloy forgings is about 30 $\mu$m as in Japanese Published Unexamined Patent Application Hei 6-256880.

The forgings include those formed by directly hot forging a cast ingot or by once extrusion molding a cast ingot and then hot forging the same. Accordingly, the shape of the cast ingot can include, for example, ingot or slab, or near net shape approximate to the final shape, with no particular restriction.

Chemical Ingredient Composition of the Al Alloy of the Present Invention

Then, the chemical ingredient composition in the Al alloy of the present invention is to be explained. It is necessary that the Al alloy according to the present invention can satisfy mechanical properties such as strength, formability and toughness, corrosion resistance or stress corrosion cracking capability as structure materials or parts for transportation machines such as automobiles and ships, or recyclic property with less amount of alloys. Among them as suspension parts for use in automobiles, particularly, it is necessary to obtain a high strength, preferably, of 350 $N/mm^2$ or more at a $\sigma_{0.2}$ and a high average toughness of 30 $J/cm^2$ or more.

Accordingly, for satisfying the foregoing characteristics, the chemical ingredient composition for the Al alloy according to the present invention, corresponding to the ingredient standards for the Al—Mg—Si series AA 6XXX series Al alloy (AA 6101, 6003, 6151, 6061, 6063 and JIS 6N01) contains, basically, Mg: 0.6–1.6%, Si: 0.6–1.8%, Cu: 0.05–1.0%, Fe 0.30% or less, hydrogen: 0.25 cc/100 g Al or less, one or more of Mn: 0.15–0.6%, Cr: 0.1–0.2% and Zr: 0.05 to 0.2% and the balance of Al and inevitable impurities. In addition, it selectively contains optionally, for example, Zn: 0.005–1.0%, Ti: 0.001–0.1% and B: 1–300 ppm. However, appropriate change for the ingredient composition for further improving the characteristics and adding other characteristics may be allowed so long as it has the fundamental characteristics although chemical ingredient does not correspond to each of the ingredient standards for the AA 6XXX series Al alloy. In this regard, it is allowed to appropriately contain other elements such as Ni, V, Sc and Ag in accordance with the change of the ingredient ranges for the elements and in accordance with more concrete application uses and required characteristics. Further, impurities intruded inevitably from scraps of molten raw materials may also be allowed within a range not hindering the quality of the forgings according to the present invention.

Amount of Elements in the Al Alloy of the Invention

Then, the contents for each of the elements of Al alloy material according to the present invention are to be explained with respect to their critical meanings and ranges.

Mg: 0.6–1.6%

Mg is an essential element of depositing together with Si as $Mg_2Si$ by artificial aging, and forming a compound phase together with Cu and Al in a Cu-containing composition to provide a high strength (yield strength) for final products upon use. If the content of Mg is less than 0.6%, the amount of work hardening is reduced and no high strength of 315 $N/mm^2$ or higher at $\sigma_{0.2}$ can be obtained in artificial aging. On the other hand, if it is contained in excess of 1.6%, the strength (yield strength) is excessively high to hinder the forgeability and the volume fraction of total constituents phase particles ($Mg_2Si$ intermetallic compounds) can not be decreased to lower than 1.5%, preferably, lower than 1.0% per unit area, which lowers the toughness and high toughness can not be obtained. Accordingly, the Mg content is defined as within a range from 0.6 to 1.6%.

Si: 0.6–1.8%

Si is an essential element depositing together with Mg as $Mg_2Si$ by artificial aging to provide high strength (yield strength) for final products upon use. If the Si content is less than 0.6%, no sufficient strength can be obtained and high strength of 315 $N/mm^2$ or higher at $\sigma_{0.2}$ can not be obtained. On the other hand, if it is contained in excess of 1.8%, it deposits as coarse elemental Si particles upon casting and hardening to lower the toughness as described above. Further, the volume fraction of total constituents phase particles ($Mg_2Si$ and Al—Fe—Si—(Mn, Cr, Zr) series intermetallic compounds) can not be reduced to 1.5% or lower, preferably, 1.0% or lower per unit area and no high toughness can be obtained. In addition, it also hinders moldability such as reduction of elongation. Accordingly, the Si content is defined as within a range from 0.6 to 1.8%.

Cu: 0.05–1.0%

Cu deposits in the form of a compound phase together with Mg and Al to contribute to the improvement of the matrix strength, as well as has an effect upon aging treatment of acting as a seed for the deposition of other alloying elements, finely dispersing deposits uniformly and remarkably promoting the age hardening of final products. If the Cu content is less than 0.05%, such effects can not be obtained. On the other hand, if the Cu content exceeds 1.0%, such effects are saturated and, rather, toughness and hot forgeability are deteriorated. Further, if the Cu content exceeds 0.3%, the corrosion resistance tends to be lowered, so that the Cu content is preferably 0.3% or less in view of the corrosion resistance. Accordingly, the Cu content is defined as from 0.05 to 1.0%, preferably, 0.05 to 0.3%.

One or more of Mn: 0.15–0.6%, Cr: 0.1–0.2% and Zr: 0.05–0.2%

Such elements form dispersed particles (dispersion phase) such as $Al_{20}Cu_2Mn_3$, $Al_{12}Mg_2Cr$ or $Al_3Zr$ upon soaking treatment and subsequent hot forging. Since such dispersed particles have an effect of hindering grain boundary migration after recrystallization, fine grains can be obtained. Further, among the elements described above, if contained in a composite form with other Mn and Cr, Zr deposits finer Al—Zr series dispersed particles of several tens to several hundreds angstrom, which are finer than Al—Mn series or Al—Cr series dispersed particles. Therefore, when contained together with Mn, Cr, Zr has significant effect of inhibiting migration on grain boundary or sub-grain boundary to suppress growing of grains and has a significant effect of improving the destruction toughness and wear characteristics. On the other hand, if such elements are contained excessively, coarse Al—Fe—Si—(Mn, Cr, Zr) series intermetallic compounds or constituents tend to be formed easily during melting and casting, which form starting points for destruction to cause reduction of the toughness. Accordingly, the volume fraction of total constituents phase particles (Al—Fe—Si—(Mn, Cr, Zr) series intermetallic compounds) can not be reduced to 1.5% or lower, preferably, 1.0% or lower per unit area and no high toughness can be obtained. Accordingly, the contents for the elements are defined as: Mn: 0.15–0.6%. Cr: 0.1–0.2% and Zr: 0.05–0.2%, respectively.

Fe: 0.30% or lower

Fe contained as an impurity in the Al alloy forms constituents of $Al_7Cu_2Fe$, $Al_{12}(Fe, Mn)_3Cu_2$, $(Fe,Mn)Al_6$ series or constituents of coarse Al—Fe—Si—(Mn, Cr, Zr) series, which cause a problem referred to in the present invention. Such constituents deteriorate the destruction toughness and wear characteristic as described above. Particularly, if the content of Fe exceeds 0.3%, more strictly, 0.25%, the volume fraction of total constituents phase particles ($Mg_2Si$ and Al—Fe—Si—(Mn, Cr, Zr) series intermetallic compounds) can not be decreased to 1.5% or lower, preferably, 1.0% or lower per unit area and no higher strength and higher toughness required for suspension parts in automobiles can not be obtained. Accordingly, the Fe content is preferably 0.30% or less and, more preferably, 0.25% or less.

Hydrogen: 0.25 cc/100 g Al or less

Hydrogen remarkably lowers the toughness and remarkably deteriorates the resistance to impact destruction. The effect of degradation in the resistance to impact destruction is particularly remarkable in suspension parts for use in automobiles which are particularly decreased in the wall thickness and increased for the strength. Accordingly, hydrogen content is defined as low as possible within a range of 0.25 cc/100 g Al or lower.

(Zn, Ti, B, Be, V)

Then, Zn, Ti, B, Be and V are elements contained selectively each depending on the purpose.

Zn: 0.005–1.0%

Zn deposits finely and at a high density as $MgZn_2$ upon artificial aging to realize a high strength. However, if the Zn content is less than 0.05%, no sufficient strength can be obtained by artificial aging. On the other hand, if it contained in excess of 1.0%, corrosion resistance lowers remarkably. Accordingly, the Zn content is preferably within a range of 0.005 to 1.0%.

Ti: 0.001–0.1%

Ti is an element added for making the grains of the cast ingot finer to improve the press moldability. However, if the Ti content is less than 0.001%, the effect can not be obtained. On the other hand, if Ti is contained in excess of 0.1%, coarse constituents are formed to lower the moldability. Accordingly, the Ti content is preferably within range from 0.001 to 0.1%.

B: 1–300 ppm

B, like Ti, is an element added for making the grains of the cast ingot finer to improve the press moldability. However, if the B content is less than 1 ppm, the effect can not be obtained. On the other hand, if B is contained in excess of 300 ppm, coarse constituents are also formed to lower the moldability. Accordingly, the B content is preferably within a range from 1–300 ppm.

Be: 0.1–100 ppm

Be is an element contained for preventing reoxidation of molten alloy in air. However, the effect can not be obtained if the content is less than 0.1 ppm and, on the other hand, the material hardness is increased to lower the moldability if it is contained in excess of 100 ppm. Accordingly, the Be content is preferably within a range from 0.1 to 100 ppm.

V: 0.15% or less

V forms dispersed particles (dispersion phase), like Mn, Cr or Zr, during soaking treatment and subsequent hot forging. Since the dispersed particles have an effect of hindering grain boundary migration after recrystallization, fine grains can be obtained. However, if it is contained in excess, coarse Al—Fe—Si—V series inter-metallic compounds or constituents are tend to be formed during melting and casting, which constitute starting points of destruction to lower the toughness. Accordingly, V is defined, if contained, to 0.15% or less.

Then, a preferred method of manufacturing a Al alloy forgings in the present invention is to be explained. Manufacture of the Al alloy forgings itself in the present invention can be conducted by a customary method. For example, when a molten Al alloy melted and adjusted within the range of the Al alloy ingredient is cast, it is cast by properly selecting a customary melt casting method such as a continuous cast rolling method, a semi-continuous casting method (DC casting method) or a hot top casting method.

However, for making the grains of the cast Al alloy ingot finer or reducing the volume fraction of total constituents phase particles ($Mg_2Si$ and Al—Fe—Si—(Mn, Cr, Zr) series intermetallic compounds) in order to improve the toughness of the Al alloy forgings, it is necessary to cast a molten Al alloy at a cooling rate of 10° C./sec or higher. If the cooling rate of the cast ingot is lower than 10° C./sec, grains become coarser and the secondary dendrite arm spacing (DAS) of the cast material can not be decreased to 30 $\mu$m or less. Further, the volume fraction of total constituents phase particles ($Mg_2Si$ and Al—Fe—Si—(Mn, Cr, Zr) series intermetallic compounds) can not be decreased to 1.5% or lower, preferably, 1.0% or lower per unit area and no higher strength and higher toughness required, for example, in suspension parts for use in automobiles can not be obtained.

Then, it is necessary that the temperature for soaking the cast Al alloy ingot (cast material) is within a range from 530 to 600° C. Usual soaking temperature for the Al cast material of this type is bout 470 to 480° C. In the present invention, one or more of Mn, Cr and Zr are contained for improving the toughness and dispersed particles (dispersion phase) such as $Al_{20}Cu_2Mn_3$, $Al_{12}Mg_2Cr$ and $Al_3Zr$ are formed upon soaking treating to obtain fine grains. Further, for improving the high yield strength and high toughness for the Al alloy forgings, it is necessary to solid solubilize the $Mg_2Si$ series constituents thoroughly in the step of the soaking treatment.

For this purpose, soaking treatment at a high temperature of 530 to 600° C. is necessary and, at a soaking temperature of lower than 530° C., the number of dispersed particles is insufficient and the grain size is enlarged. In addition, the solid solubilization amount of the $Mg_2Si$ series constituents is also insufficient and it is impossible to reduce the volume fraction of total constituents phase particles ($Mg_2Si$ and Al—Fe—Si—(Mn, Cr, Zr) series intermetallic compounds) to 1.5% or less, preferably, 1.0% or less per unit area, so that it is impossible to obtain higher strength and higher toughness, more concretely, a high toughness at a Chalpy impact value of 20 J/cm$^2$ or higher with a high strength of 315 N/mm$^2$ or more at $\sigma_{0.2}$, required, for example, in suspension parts for use in automobiles. On the other hand, if the soaking temperature exceeds 600° C., the effect remains unchanged and, rather, it brings about a problem such as melting loss of Al cast alloy ingot (cast material).

After the soaking treatment, the material is hot forged by mechanical forging or hydraulic pressure forging into a Al alloy forgings in the shape of a finer product (near net shape). Then, after forging, tempering such as T6 treatment (hardening after the solid solubilization) and aging treatment are conducted in order to obtain necessary strength and toughness after forging.

Further, for eliminating the cast structure remaining in the Al alloy forgings and further improving the strength and the toughness, the cast Al alloy material may be forged after being subjected to soaking, and then extrusion molding.

EXAMPLE

Examples of the present invention will be explained. Al alloy ingots shown in Table 1 (Al alloy forgings: each round bar of 68 mm Ø×580 mm length) were melted and cast by casting method shown in Tables 2 and 3 (DC casting method, hot top casting method) at a cooling rate (° C./sec) shown in Tables 2 and 3, and applied with soaking treatment at temperatures shown in Table 2 each for 8 hours and then hot forged by mechanical forging into the shape of automobile suspension parts at each forging ratio shown in Tables 2 and 3 to manufacture Al alloy forgings 1 of the shape shown in FIG. 1. Then, after solubilizing the Al alloy forgings by using a nitrate furnace at 560° C. for one hour, they were cooled with water (water hardening) and, subsequently, put to aging treatment for at 180° C. for 5 hours. Cast ingot No. 5 of the invention shown in Table 3 was soaked, then extrusion molded at a extrusion ratio 6 and hot forged.

Then, test specimens were sampled from the cast Al alloy ingots and Al alloy forgings respectively, the structures of the cast ingots and the Al alloy forgings 1 in the cross section along the thickness were observed by using a scanning type electron microscope (SEM) at 800 magnification ratio with the number of view fields (measuring points) of the specimen as 10 and put to image analysis, to determine the volume fraction of total constituents phase particles ($Mg_2Si$ and Al—Fe—Si—(Mn, Cr, Zr) series intermetallic compounds) per unit area (0.0127 mm$^2$) (average for each of the view fields). Further, the secondary dendrite arm spacing (DAS, $\mu$m) in the cast Al alloy ingots was also determined from a microstructure photograph for the cast ingots according to the intersection method as defined in "Method of Measuring Aluminum Dendrite Arm Spacing and Cooling Rate" (Research Committee of Light Metal Association, 1988, 8). The results are shown in Tables 2 and 3.

Further, mechanical properties of the specimens sampled from the Al alloy forgings 1 such as tensile strength ($\sigma_s$, N/mm$^2$), yield strength ($\sigma_{0.2}$, N/mm$^2$) elongation ($\delta$, %), toughness=Charpy impact value (J/cm$^2$) were measured. In the measurement, for examining the scattering of mechanical properties between each of the portions of the Al alloy forgings 1 due to the difference of the forging ratio, the test specimens were sampled from the portion $T_1$ where the forging ratio is greatest and the portion $T_2$ where the forging ratio is smallest. The forging ratio was calculated as the reduction ratio of the cross sectional area. Then, the average for the mechanical properties in these portions was also measured to determine average mechanical properties over the entire Al alloy forgings 1. The results are also shown in Tables 2 and 3.

As apparent from Table 2, examples of the invention Nos. 1 and 5 each using the Al alloy No. 1 in Table 1 having the chemical ingredient composition within the scope of the present invention, for example, in that the Fe content is restricted to 0.30% or less and the hydrogen content is restricted as low as 0.25 cc/100 g Al or lower, with the casting cooling rate and the soaking temperature satisfying the manufacturing method of the present invention ensures high strength and high toughness, even at the portion $T_2$ where the forging ratio is smallest as 50% and ensures average mechanical properties as the entire Al alloy forgings, particularly, a yield strength ($\sigma_{0.2}$) of 350 N/mm$^2$ or more and the average toughness of 30 J/cm$^2$ or more. The structures of the Al alloy forgings of the examples had structures in which Al—Fe—Si—(Mn, Cr, Zr) series constituents 3 were finely dispersed with a spacing between each other as shown in FIG. 1A.

In the examples of the invention shown in Table 2, Example No. 2 uses a relatively low casting cooling rate and shows a relatively increased secondary dendrite arm spacing (DAS) compared with Examples Nos. 1 and 5. Further, In Example No. 4, the soaking temperature is relatively low, dispersed particles such as Mn, Cr and Zr are less formed and the grain is relatively coarse. Further, Example No. 3, uses Al alloy No. 2 in Table 1 containing relatively high Si, Fe and Mg amounts in which the volume fraction of total constituents phase particles ($Mg_2Si$ and Al—Fe—Si—(Mn, Cr, Zr) series intermetallic compounds) is relatively high. As a result, the examples described above ensure average mechanical properties as the entire Al alloy forgings, particularly, an average yield strength ($\sigma_{0.2}$) of 315 N/mm$^2$ or more and an average toughness value of 20 J/cm$^2$ or more but the strength and the toughness at the portion $T_2$ where the forging ratio is lowest as 50% are inferior to those of Examples Nos. 1 and 5.

Further, from the comparison between Example No. 1 containing Zr together with Mn and Cr and Example No. 6 of substantially the same composition except for not containing Zr, Example No. 1 shows higher toughness value. From the result, it can be seen that Zr has an excellent effect of improving the toughness.

On the other hand, apparent from in Table 3, Comparative Example No. 7 using No. 3 Al alloy in Table 1 with the Fe content in excess of the range of the present invention, particularly, has a volume fraction of total constituents phase particles ($Mg_2Si$ and Al—Fe—Si—(Mn, Cr, Zr) series intermetallic compounds) which is out of the range of the present invention. Further, Comparative Example No. 8 which uses the casting cooling rate lower than that in the manufacturing method of the present invention has secondary dendrite arm spacing (DAS) out of the scope of the present invention. Further, in Comparative Example No. 9, the soaking temperature is lower than that in the manufacturing method according to the present invention, dispersed particles such as Mn, Cr and Zr are less formed and the grains are relatively coarse. Accordingly, in any of the comparative examples, the strength and the toughness are low, particularly, at the portion $T_2$ where the forging ratio is at the smallest as 50% and the average mechanical properties for the entire Al alloy forgings 1 include, for example, a yield strength ($\sigma_2$) of the 315 N/mm$^2$ or less and an average toughness value of 20 J/cm$^2$ or less. Further, also Comparative Example No. 10 using No. 5 Al alloy in Table 1 with the hydrogen content exceeding range of the present invention shows remarkably low average mechanical properties for the entire Al alloy forgings, such as a yield strength ($\sigma_{0.2}$) of 315 N/mm$^2$ or less and the average toughness value of 20 J/cm$^2$ or less like that in other comparative examples.

Then, Al—Fe—Si—(Mn, Cr, Zr) series constituents of Comparative Example No. 7 had a shape in which constituents are chained lengthwise to each other as shown in FIG. 1B.

It can be seen from the foregoing examples that high strength and high toughness aluminum alloy forgings having, as a whole, a strength at $\sigma_{0.2}$ of 315 N/mm$^2$ or more and an impact shock value of 20 J/cm$^2$ or more can be obtained for forgings of various shapes such as structural materials and suspension parts such as knuckles, lower arms and upper arms for transportation machines, for example, automobiles or vehicles, even when the forging ratio is lowered depending on the portions of the parts by hot forging. Accordingly, critical meanings for each of conditions are defined for the high strength and high toughness aluminum alloy forgings and aluminum alloy materials for fabrication, as well as manufacturing methods for the aluminum alloy forgings according to the present invention.

TABLE 1

| | Al alloy chemical compositions(mass %: $H_2$ at 0.25 cc/100 g Al, balance Al) | | | | | | | | | | |
|---|---|---|---|---|---|---|---|---|---|---|---|
| No. | Si | Fe | Cu | Mn | Mg | Cr | Zn | Zr | Ti | $H_2$ | Remarks |
| 1 | 0.99 | 0.24 | 0.34 | 0.38 | 0.80 | 0.15 | 0.00 | 0.12 | 0.03 | 0.16 | Mn, Cr, Zr incorporated |
| 2 | 1.10 | 0.29 | 0.25 | 0.02 | 0.76 | 0.15 | 0.02 | 0.00 | 0.02 | 0.18 | Corresp. to JIS 6151 |
| 3 | 1.05 | 0.32 | 0.34 | 0.38 | 0.82 | 0.14 | 0.01 | 0.11 | 0.04 | 0.18 | Over Fe upper limit |
| 4 | 0.99 | 0.24 | 0.34 | 0.38 | 0.80 | 0.15 | 0.00 | 0.12 | 0.03 | 0.30 | Over $H_2$ upper limit |
| 5 | 0.98 | 0.27 | 0.33 | 0.38 | 0.83 | 0.13 | 0.00 | 0.01 | 0.04 | 0.15 | Mn, Cr incorporated |

TABLE 2

| | | | | | Cast al alloy material | | | Al alloy forgings | | | | | | |
|---|---|---|---|---|---|---|---|---|---|---|---|---|---|---|
| | | | Cast condition | | | | Soaking | | | | Mechanical properties | | | |
| No. | Section | Specimen No. Table 1 | Casting method | Cooling rate (° C./sec) | Volume fraction of total constituents phase particles (%) | DAS (μm) | temperature (° C.) | Portion | Hot forging (%) | Volume fraction of total constituents phase particles (%) | $\sigma_B$ (N/mm$^2$) | $\sigma_{0.2}$ (N/mm$^2$) | δ (%) | Chalpy (J/cm$^2$) |
| 1 | Example | 1 | Hot top | 20 | 0.92 | 22 | 550 | $T_1$ | 75 | 0.89 | 393 | 374 | 19.6 | 38.1 |
| | | | | | | | | $T_2$ | 50 | 0.90 | 377 | 359 | 18.2 | 28.3 |
| | | | | | | | | Average | | | 385 | 367 | 18.9 | 33.2 |
| 2 | Example | 1 | DC | 10 | 1.25 | 31 | 550 | $T_1$ | 75 | 1.24 | 386 | 352 | 16.6 | 28.4 |
| | | | | Near lower limit | | Near upper limit | | $T_2$ | 50 | 1.25 | 386 | 359 | 14.0 | 18.6 |
| | | | | | | | | Average | | | 386 | 356 | 15.3 | 23.5 |

TABLE 2-continued

| | | | Cast condition | | Cast al alloy material | | Soaking | Al alloy forgings | | | Mechanical properties | | | |
|---|---|---|---|---|---|---|---|---|---|---|---|---|---|---|
| No. | Section | Specimen No. Table 1 | Casting method | Cooling rate (° C./sec) | Volume fraction of total constituents phase particles (%) | DAS (μm) | temperature (° C.) | Portion | Hot forging (%) | Volume fraction of total constituents phase particles (%) | $\sigma_B$ (N/mm$^2$) | $\sigma_{0.2}$ (N/mm$^2$) | δ (%) | Chalpy (J/cm$^2$) |
| 3 | Example | 2 | Hot top | 20 | 1.51 Near upper limit | 22 | 550 | $T_1$ | 75 | 1.54 | 387 | 360 | 16.3 | 28.2 |
| | | | | | | | | $T_2$ | 50 | 1.49 | 381 | 353 | 16.0 | 14.2 |
| | | | | | | | | Average | | | 384 | 357 | 16.2 | 21.2 |
| 4 | Example | 1 | Hot top | 20 | 1.16 | 22 | 530 Near lower limit | $T_1$ | 75 | 1.09 | 390 | 360 | 17.0 | 35.5 |
| | | | | | | | | $T_2$ | 50 | 1.09 | 388 | 359 | 16.6 | 20.7 |
| | | | | | | | | Average | | | 389 | 360 | 16.8 | 28.1 |
| 5 | Example | 1 | DC | 10 | 0.98 | 31 | 550 | $T_1$ | 75 | 0.94 | 396 | 364 | 17.0 | 36.7 |
| | | | | | | | | $T_2$ | 50 | 0.97 | 392 | 362 | 16.0 | 27.1 |
| | | | | | | | | Average | | | 394 | 363 | 16.5 | 31.9 |
| 6 | Example | 5 | Hot top | 20 | 0.90 | 21 | 550 | $T_1$ | 75 | 0.86 | 387 | 356 | 16.5 | 27.6 |
| | | | | | | | | $T_2$ | 50 | 0.89 | 385 | 353 | 14.9 | 15.6 |
| | | | | | | | | Average | | | 386 | 355 | 15.7 | 21.6 |

TABLE 3

| | | | Cast condition | | Cast al alloy material | | Soaking | Al alloy forgings | | | Mechanical properties | | | |
|---|---|---|---|---|---|---|---|---|---|---|---|---|---|---|
| No. | Section | Specimen No. Table 1 | Casting method | Cooling rate (° C./sec) | Volume fraction of total constituents phase particles (%) | DAS (μm) | temperature (° C.) | Portion | Hot forging (%) | Volume fraction of total constituents phase particles (%) | $\sigma_B$ (N/mm$^2$) | $\sigma_{0.2}$ (N/mm$^2$) | δ (%) | Charpy (J/cm$^2$) |
| 7 | Comparative Example | 3 | Hot top | 20 | 2.20 Over upper limit | 22 | 550 | $T_1$ | 75 | 2.12 | 388 | 358 | 13.0 | 16.6 |
| | | | | | | | | $T_2$ | 50 | 2.15 | 379 | 350 | 12.3 | 10.0 |
| | | | | | | | | Average | | | 384 | 354 | 12.7 | 13.3 |
| 8 | Comparative Example | 1 | DC | 8 Under lower limit | 2.43 | 35 Over upper limit | 550 | $T_1$ | 75 | 2.43 | 386 | 350 | 13.1 | 21.9 |
| | | | | | | | | $T_2$ | 50 | 2.46 | 370 | 336 | 12.0 | 13.5 |
| | | | | | | | | Average | | | 378 | 343 | 12.6 | 17.7 |
| 9 | Comparative Example | 2 | Hot top | 20 | 3.46 | 22 | 470 Under lower limit | $T_1$ | 75 | 3.41 | 385 | 352 | 11.5 | 18.7 |
| | | | | | | | | $T_2$ | 50 | 3.44 | 377 | 345 | 11.0 | 10.9 |
| | | | | | | | | Average | | | 381 | 349 | 11.3 | 14.8 |
| 10 | Comparative Example | 4 | Hot top | 20 | 1.16 | 22 | 550 | $T_1$ | 75 | 1.07 | 376 | 364 | 10.9 | 17.5 |
| | | | | | | | | $T_2$ | 50 | 1.12 | 382 | 350 | 12.3 | 9.6 |
| | | | | | | | | Average | | | 379 | 357 | 11.6 | 13.6 |

What is claimed is:

1. An aluminum alloy forging comprising

Mg: 0.6–1.6% (mass % here and hereinafter),

Si: 0.6–1.8%,

Cu: 0.05–1.0%,

Fe: 0.30% or less, one or more of Mn: 0.15–0.6% and Cr: 0.1–0.2%,

Zr: 0.05–0.2%, hydrogen: 0.25 cc/100 g Al or less, and a balance of Al and inevitable impurities, wherein the aluminum alloy forging is produced by a process comprising casting an aluminum alloy at a cooling rate of 10° C./sec or higher to form a cast aluminum alloy ingot, subjecting the cast aluminum alloy ingot to a soaking heat treatment at a temperature of 530–600° C., and then hot forging the cast aluminum alloy ingot, and wherein a volume fraction of total constituents phase particles ($Mg_2Si$ and Al—Fe—Si—(Mn, Cr, Zr) series intermetallic compounds) in the aluminum alloy forging is 1.5% or less per unit area.

2. The aluminum alloy forging as defined in claim 1, wherein a volume fraction of total constituents phase particles ($Mg_2Si$ and Al—Fe—Si—(Mn, Cr, Zr) series intermetallic compounds) per unit area is 1.0% or less.

3. The aluminum alloy forging as defined in claim 1, wherein the Fe is restricted to 0.25% or less.

4. The aluminum alloy forging as defined in claim 1, wherein a secondary dendrite arm spacing (DAS) of the cast aluminum alloy ingot is 30 $\mu$m or less.

5. The aluminum alloy forging as defined in claim 1, wherein the hot forging comprises extrusion molding or extrusion fabricating the cast aluminum alloy ingot.

6. The aluminum alloy forging as defined in claim 1, wherein an average value of a yield strength ($\sigma_{0.2}$) is 350 N/mm$^2$ or more and an average value for a Charpy impact value is 30 J/cm$^2$ or more.

7. The aluminum alloy forging as defined in claim 1, wherein the aluminum alloy forging has a portion with a hot forging ratio of 75% or less.

8. The aluminum alloy forging as defined in claim 1, wherein the aluminum alloy forging is a part of a transportation machine.

9. The aluminum alloy forging as defined in claim 1, wherein the aluminum alloy forging is a part of an automobile suspension.

10. A method of making an aluminum alloy forging, the method comprising casting an aluminum alloy at a cooling rate of 10° C./sec or higher to form a cast aluminum alloy ingot, subjecting the cast aluminum alloy ingot to a soaking heat treatment at a temperature of 530–600° C., then hot forging the cast aluminum alloy ingot, and forming the aluminum alloy forging of claim 1.

* * * * *